United States Patent [19]

Emadi et al.

[11] Patent Number: 4,834,678

[45] Date of Patent: May 30, 1989

[54] HIGH VOLTAGE CONTACT ASSEMBLY

[75] Inventors: Atahusain Emadi, Mechanicsburg; Daniel J. Mignogna, Harrisburg, both of Pa.

[73] Assignee: AMP Incorporated, Harrisburg, Pa.

[21] Appl. No.: 200,397

[22] Filed: May 31, 1988

[51] Int. Cl.[4] ..... H01R 13/426

[52] U.S. Cl. ..... 439/701; 439/744

[58] Field of Search ..... 439/686, 695, 701, 744, 439/745, 752, 281

[56] References Cited

U.S. PATENT DOCUMENTS

| | | | |
|---|---|---|---|
| 3,321,733 | 5/1987 | Thomas | 439/271 |
| 3,475,720 | 10/1969 | Culver | 439/744 |
| 3,794,958 | 2/1974 | Glover | 439/274 |
| 3,963,295 | 6/1976 | Askman et al. | 439/276 |

FOREIGN PATENT DOCUMENTS

| | | | |
|---|---|---|---|
| 2344978 | 10/1977 | France | 439/744 |

OTHER PUBLICATIONS

ITT Cannon Catalog D-17/Jan. 1986, "D Subminiature Connectors", p. 37, ITT Cannon, Fountain Valley, California.

AMP Catalog 79-547 Revised 1-85, "Amplimite Subminiature D Pin and Socket Connectors per MIL--C-24308", pp. 6,15-16, AMP Incorporated, Harrisburg, Pennsylvania.

*Primary Examiner*—Gary F. Paumen

*Attorney, Agent, or Firm*—Anton P. Ness

[57] ABSTRACT

A kit for assembling an electrical connector for high voltage connections has only a pin contact terminal crimpable to a stripped conductor wire, a socket contact terminal crimpable to a stripped conductor wire, a terminal housing subassembly into which the crimped pin contact terminal is insertable, a terminal housing subassembly into which the crimped socket contact terminal is insertable, and connector housings having passageways into which the housing subassemblies are insertable. Each housing subassembly includes a rearward section extending rearwardly from the termination of the stripped conductor wire to the terminal and along a length of the insulated conductor, to establish a long voltage leakage path for minimizing corona discharge events during in-service use. Each housing subassembly contains a retention clip therewithin to secure the terminal upon insertion, and also includes another retention clip therearound to retain the housing subassembly within the connector housing upon insertion into a housing passageway. The housing subassemblies include matable forward hood sections surrounding the pin and socket contact sections and establishing a long voltage leakage path along the connector mating face.

13 Claims, 3 Drawing Sheets

HIGH VOLTAGE CONTACT ASSEMBLY

FIELD OF THE INVENTION present invention relates to the field of electrical connectors and more particularly to connectors for high voltage applications.

BACKGROUND OF THE INVENTION

Certain applications of electrical connections involve the transmission of electrical signals at high voltage, such as at 1800 volts or higher, and the signals may be continuous or pulsed. Electrical connector products are known which are useful for such applications, and one of the primary concerns is the occurrence of corona discharge and also the detrimental effects such discharge events can have on the structure of the insulation material of electrical connectors, including degradation and possible breakdown of the dielectric insulation around the terminals and the exposed conductor wires. One product is known in which the conductor wire is soldered to a termination end of the contact terminal, and the housing member must provide access to the termination end for such soldering to be performed by soldering tools. Such access involves at least a physical gap through the portion of the dielectric housing surrounding the termination area, and such a gap could permit corona discharge therethrough because a short voltage leakage path is established through the air between the conductive material at the termination site and the outside environment. In order to eliminate the short voltage path it is necessary to fill the gap after the termination step by a further step such as by using potting compound which will harden and thereby form a physical dielectric structure completely around the termination.

It is desirable to provide an electrical connector assembly especially adapted to minimize the occurrence of corona discharge events.

It is desirable to provide such an electrical connector which minimizes and simplifies the steps involved in assembly and complete application of the connector to the conductor wires remote from the manufacturing site.

SUMMARY OF THE INVENTION

The present invention provides an assembly for mating terminals for transmitting signals under high voltage wherein the pin terminal and the socket terminal are terminated to their respective conductor wires by crimping. The assembly is in kit form and is easily assembled in the field remote from the manufacturing site with only a standard crimping tool. Each terminal thus crimped to a wire is inserted into a profiled passageway of a respective terminal housing subassembly and is secured therein by a retention clip against forward and rearward axial movement, thus forming a terminal assembly. Each of the terminal assemblies is then secured in a respective profiled passageway of a respective connector housing by a second retention clip.

The terminal housing subassemblies provide complete dielectric insulator around the respective terminals and include forward hood sections coextending forwardly along the pin contact section and the socket contact section of the respective pin and socket terminals, with the pin's hood section being of a larger diameter to receive the socket's hood section thereinto. The terminal housing subassemblies also each include an elongated rearward end extending a distance rearwardly from the crimp termination of the terminal to the conductor wire, which establishes a substantially long voltage leakage path and minimizes corona discharge events during in-service use.

According to one aspect of the present invention, each terminal housing subassembly can comprise two housing members bonded together to secure the terminal's retention clip along the profiled passageway after insertion of the terminal thereinto by means of an enlarged central passageway defined by forwardly facing and rearwardly facing stop shoulders each on a respective one of the housing members. The rearward housing member can include a forwardly extending flange dimensioned to tightly fit around and along a smaller diameter rearwardly extending flange of the forward housing member thereafter ultrasonically bonded together to eliminate any gap therebetween. The terminal-retaining clip can be a C-shaped spring clip member spring loadedly disposed within the rearwardly extending flange of the forward housing member prior to bonding the rearward housing member thereto.

According to another aspect of the present invention, the retention clip securing the terminal assembly within the connector housing is previously secured around the terminal housing subassembly instead of being previously secured within the connector housing passageway, thus permitting the connector housing in applications containing only high voltage terminals of the present invention, to be molded in one piece with one retention shoulder along the passageway.

An embodiment of the present invention will now be described with reference to the accompanying drawings.

DETAILED DESCRIPTION OF THE PREFERRED EMBODIMENT

Figure 1:
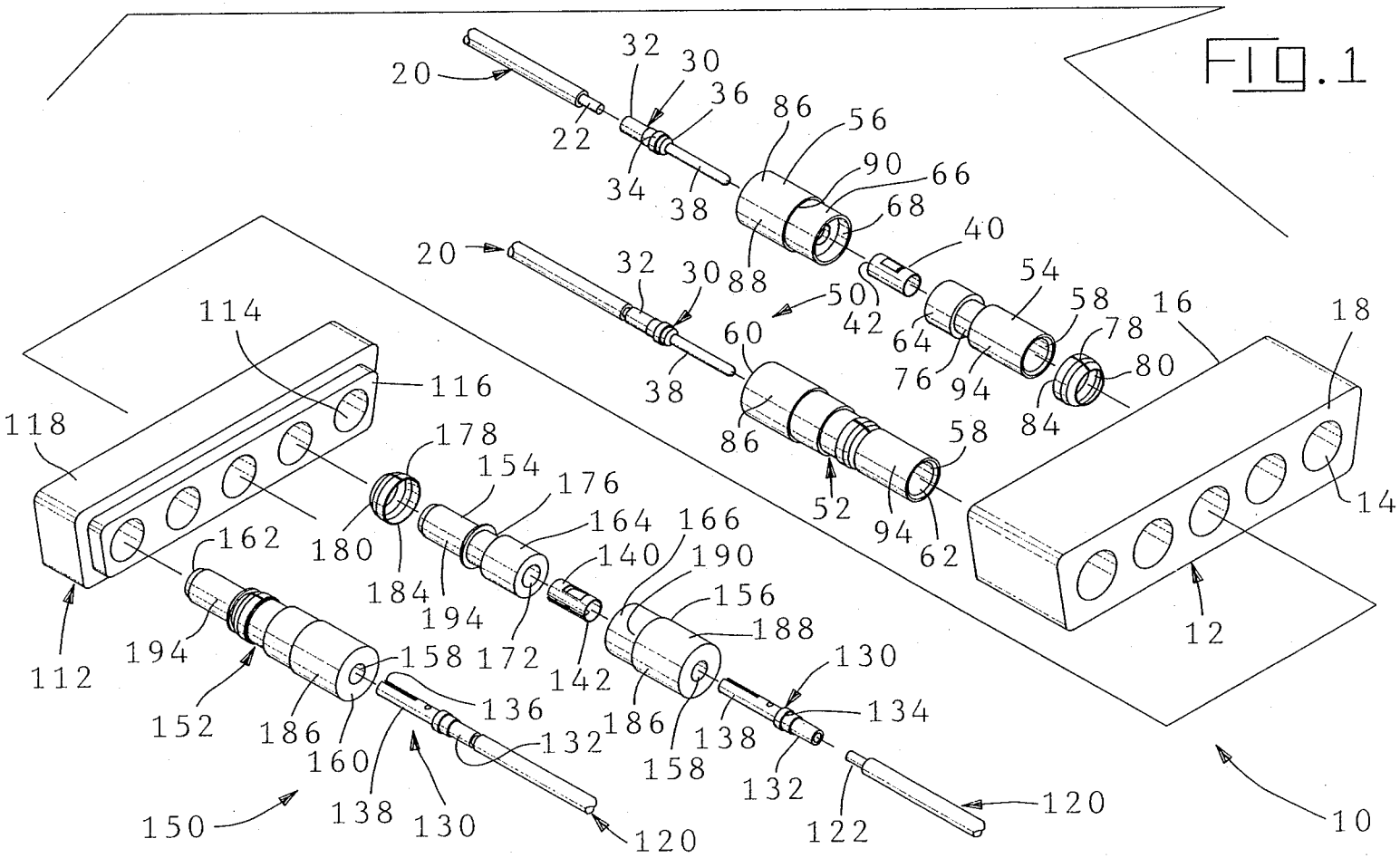
FIG. 1 is an exploded isometric view of a pin terminal and a mating socket terminal, their conductors, terminal housings, retention clips and connector housings of a high voltage connector assembly of the present invention, along with assembled terminal housing subassemblies to receive the terminals thereinto.
Figure 2:
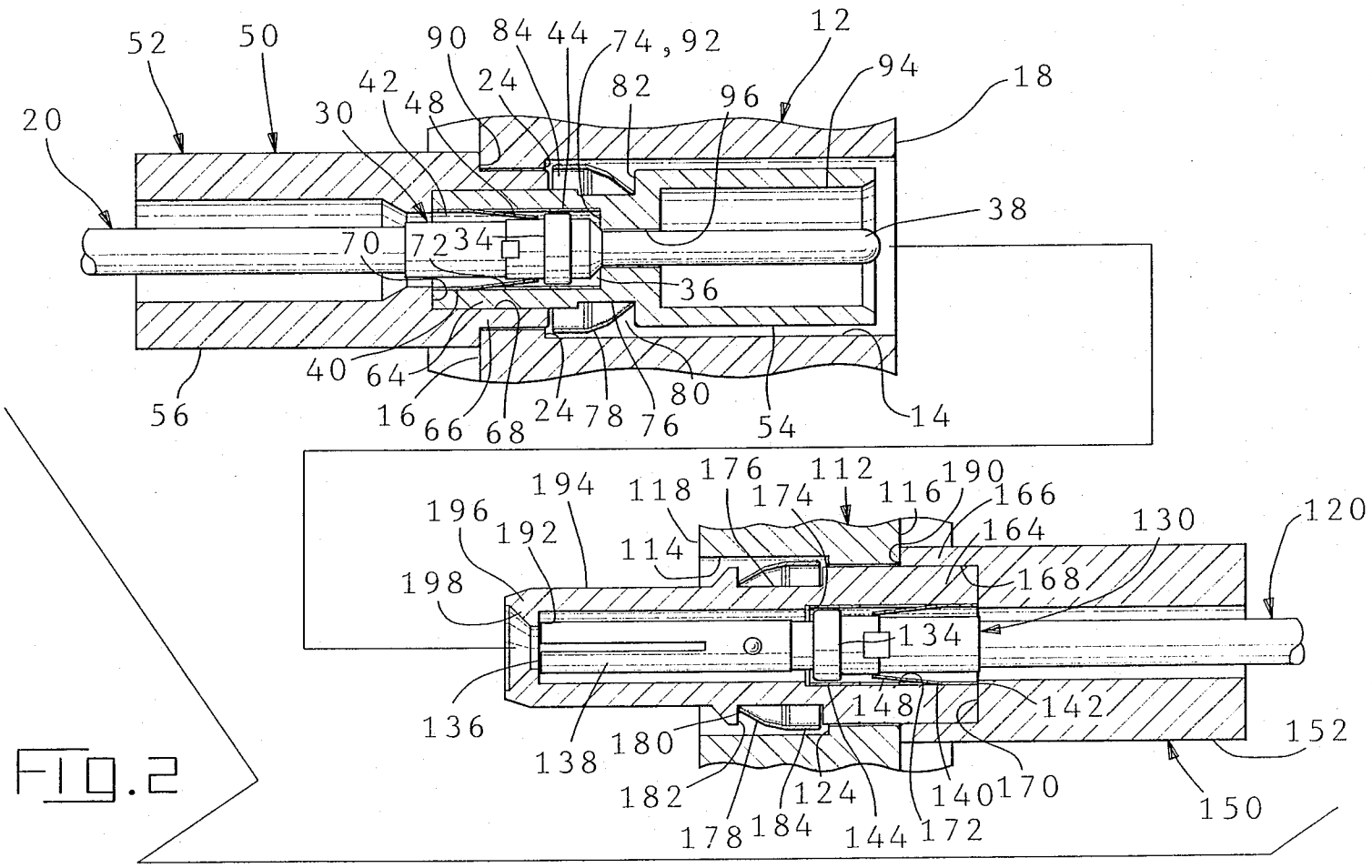
FIGS. 2 and 3 are longitudinal section views of a pin terminal assembly and a mating socket terminal assembly both prior to and after mating engagement, respectively.
Figure 3:
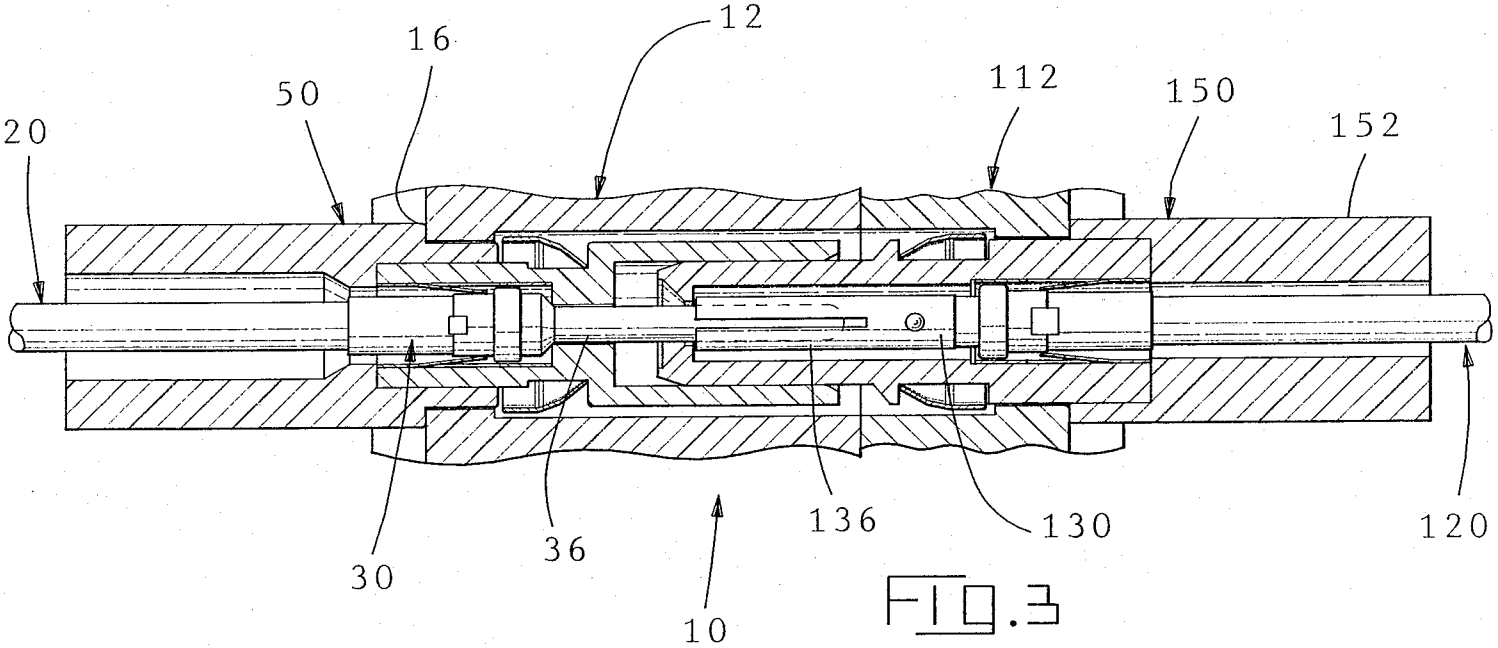

In FIG. 1 a connector assembly 10 is shown to include a pair of dielectric connector housing members 12,112 each having a plurality of passageways 14,114 therethrough from a rearward face 16,116 to a mating face 18,118. Optionally a metal shell (not shown) may be placed around the mated connector assembly for shielding, as is conventional. Insulated conductors 20,120 include conductor wires 22,122 for transmission of signals at signal current levels under high voltage such as at levels of one or more kilovolts. Stripped ends of wires 22,122 are terminated by crimping to respective pin and socket terminals 30,130 within rearward termination barrels 32,132. When terminals 30,130 are terminated to conductor wires 22,122, terminal housing subassemblies 52,152 are inserted thereover to define terminal assemblies 50,150 which are then ready for insertion into respective passageways 14,114 of connector housing members 12,112 to complete the assembly.

Referring to all of the Figures, each of the terminal housing subassemblies 52,152 preferably comprises a dielectric forward housing member 54,154 and a dielectric rearward housing member 56,156 which when assembled together will include a terminal passageway 58,158 extending therethrough from a terminal-receiving end 60,160 to a mating end 62,162. Forward housing member 54,154 includes a rearwardly extending flange section 64,164; and rearward housing member 56,156 includes a forwardly extending flange section 66,166 defining a cavity 68,168 having an inside diameter just large enough to permit receipt of flange section 64,164 thereinto. Rearward end of 70,170 defines a forwardly facing stop shoulder against which a rearward end 42,142 of terminal retention clip 40,140 will engage after assembly. Forward housing member 54,154 includes a slightly enlarged rearward passageway section 72,172 within which retention clip 40,140 will be disposed. Rearward passageway section 72,172 defines a rearwardly facing stop shoulder 74,174 engageable by forward end 44,144 of terminal retention clip 40,140 after assembly. Upon assembly of rearward housing member 56,156 to forward housing member 54,154 with flange section 66,166 around and along flange section 64,164 the interface between their surfaces is bonded to eliminate any air gap therebetween such as by adhesive material or preferably by ultrasonic welding according to conventionally known processes.

Preferably terminal retention clip 40,140 is a stamped and formed C-shaped cylindrical spring member formed to have an outer diameter after forming slightly larger than the diameter of enlarged passageway section 72,172 so that clip 40,140 will retain itself therewithin under radially outward spring bias. Optionally clip 40,140 may be inserted into terminal housing subassembly 52,152 after housing members 54,154;56,156 are assembled, or preferably it may be inserted into enlarged passageway section 72,172 prior to the assembling together of forward and rearward housing members 54,154;56,156. Upon the insertion of terminal 30,130 into the respective one of terminal housing subassemblies 52,152 retention clip 40,140 therewithin will prevent axially forward and axially rearward movement of the terminal thereafter.

After assembly of the forward and rearward housing members, an annular clip-receiving recess 76,176 is defined around the terminal housing subassemblies 52,152 to receive second retention clip 78,178 therearound. Second retention clip 78,178 may be a C-shaped spring clip which is snapped onto the subassembly and then crimped to properly secure it within the annular recess. Such C-shaped spring clips are known and are used with contact terminals sold by AMP Incorporated under the designation Power Contacts, Size 8, Part Nos. 211159-1 and 211161-1 for use in AMPLIMITE Subminiature D Series 109 Connectors. Forward clip end 80,180 is formed to extend inwardly toward and to the bottom surface of annular recess 76,176 and forwardly to engage a rearwardly facing shoulder 82,182. Rearward clip end 84,184 is spaced radially outwardly from the bottom surface of annular recess 76,176 to engage a corresponding stop surface 24,124 along profiled passageway 14,114 of connector housing 12,112 after full assembly of the connectors.

Each of terminal housing subassemblies 52,152 includes a rearward section 86,186 having a length selected so that it extends completely along the rearward termination barrel 32,132 of the respective terminal 30,130 after the terminal has been terminated to the conductor and preferably rearwardly of the rearwardmost end thereof. Preferably the inner diameter of rearward section 86,186 is just large enough to enable insertion of terminal 30,130 thereinto thus resulting in only a very small air gap therebetween. During in-service use rearward section 86,186 will provide a substantial length of dielectric material rearwardly of any exposed portion of wire conductor 22,122 and any portion of terminal 30,130 and thereby create a long voltage leakage path which will minimize corona discharge events.

Rearward section 86,186 is circumferentially continuous and extends rearwardly of connector housing 12,112 after assembly and includes an enlarged section 88,188 having an outer diameter greater than the diameter of connector housing passageway 18,118 thereby defining a forwardly facing stop surface 90,190 engageable with the rearward face of connector housing 12,112 to establish a means for stopping forward axial movement of terminal assembly 50,150 after full insertion, which in cooperation with rearward end 84,184 of retention clip 78,178 against stop surface 24,124 retains terminal assembly 50,150 within connector housing 12,112. Rearward section 86,186 also eliminates the necessity of housing 12,112 having to extend a corresponding substantial distance farther rearwardly to provide an equivalent dielectric structure rearwardly of the termination of the wire conductor to the terminal and enabling the use of existing connector housing profiles now in use such as those sold by AMP Incorporated under the designation AMPLIMITE Subminiature D Series 109 Housings for Power/Coax and Size 20 Signal Contacts, such as Part Nos. 212491-1 and 212059-1.

Terminals 30,130 include annular collars therearound which define rearwardly facing stop shoulders 34,134 engageable by forward ends of forwardly and inwardly extending lances 48,148 of retention clips 40,140. The terminals also include structure comprising forwardly facing stop surfaces 36,136 as is conventional, which cooperate with rearwardly facing stop surfaces 92,192 along passageway 58,158 of terminal housing subassembly 52,152 to stop axially forward movement of terminal 30,130 after full insertion thereinto.

Pin terminal 30 includes a pin contact section 38 disposed within a large diameter, circumferentially continuous hood section 94 of terminal housing subassembly 52 and extends to the mating end 62 thereof. The base of pin contact section 38 is disposed within a small diameter passageway portion 96 of passageway 58. Socket terminal 130 includes a socket contact section 138, and socket contact section 138 is disposed within a circumferentially continuous hood section 194 of terminal housing subassembly 152 and extends almost to mating end 162 thereof. Hood section 194 has an inner diameter large enough to permit slight but essential outward deflection of the beams comprising the socket contact section by the mating pin section, thereby establishing inward spring bias of the beams against the pin contact section for assured contact normal force, as is conventional. Optionally, the socket terminal may have a hood section crimped thereto around the socket contact section.

The forward end of hood section 194 includes a reduced diameter portion 196 which can provide the stop surface 192 for socket terminal 130 cooperable with the forward end of the socket contact section 138 comprising stop means 136. Reduced diameter portion 196 includes inwardly and rearwardly tapering surfaces 198 comprising lead-ins to align the corresponding pin contact section 38 with socket contact section 138 during mating. Hood section 94 of pin terminal housing subassembly 52 includes tapered surfaces to serve as lead-in means to receive hood section 194 of socket terminal housing subassembly 152 during mating, and the outer periphery of the forward end of hood section 194 can be correspondingly tapered to cooperate therewith.

Preferably housing members 54,154;56,156 are molded of liquid crystal polymer such as VECTRA LCP A130 polyester, 30% glass filled, sold by Celanese Corporation or ULTEM amorphous thermoplastic polyetherimide sold by General Electric Company. Retention clip 86,186 is preferably of phosphor bronze alloy which is nickel plated, and retention clip 40,140 is preferably stainless steel. Pin terminal 30 is preferably gold-plated brass and socket terminal 130 is preferably gold-plated beryllium copper, both preferably being screw machined members and suitable for high voltage application. Connector housings 12,112 may be molded of thermoplastic resin such as diallylphthalate.

The present invention can be made to be sold in kit form for ease of assembly in the field remote from the manufacturing site, and can comprise two parts for the pin terminal connector assembly 50 and two parts for the socket connector assembly 150: the terminal ready to be conventionally crimped to the stripped conductor wire; and, the terminal housing subassembly including the terminal-securing retention clip already secured within, and the connector-securing retention clip secured to the outside of the subassembly. Once the terminal is crimped to the wire, it is simply insertable into the corresponding terminal subassembly until fully seated, and no soldering nor potting is required by the person applying the connector assembly to the conductor wires. The terminal assembly is ready to be inserted into a connector housing until fully seated, thereby defining connector assembly for high voltage applications with satisfactory dielectric structure to minimize the possibility of corona discharge events.

Testing of samples of the present invention was performed in accordance with established tests. In a test for corona discharge events (AMP Test Spec. 109-40) within ranges of microcoulombs over sixty seconds, in a connector assembly containing five terminal assemblies of the present invention, with a metal shell around the connector housings: between a first pair of adjacent contacts 25 discharges occurred below eight microcoulombs; eleven discharges occurred below fourteen microcoulombs between another pair of adjacent contacts; three discharges occurred below four microcoulombs from the contacts to the shell; and no discharges occurred above fourteen microcoulombs, yielding excellent results. In another test for dielectric withstanding (Military Standard 1344, Method 3001), a mated connector assembly with shell was tested for different voltage levels, and the test was successfully passed by the assembly at seven kilovolts. In a third test for testing of the dielectric to breakdown (also Military Standard 1344, Method 3001), where foil was wrapped around the contacts, failure occurred at 15 kv; where the connector assembly with five terminals was enclosed within a shell, failure occurred at 11.5 kv; in the remainder of the test failures occurred at and above 13.5 kv; and in all cases when failure occurred it was discharge through the air and not the result of breakdown of the dielectric structure. The tests were successfully passed with considerable margin.

The embodiment described represents the preferred embodiment of the present invention. Modifications may occur to the artisan which are in keeping with the spirit of the invention, and which are within the scope of the claims hereinafter set forth.

What is claimed is:

1. A connector assembly suitable for high voltage applications to connect electrical conductors having conductor wires therein, comprising:

first and second terminal means including respective first and second termination sections at rearward ends thereof adapted to be crimped to stripped ends of respective conductor wires, said first and second terminal means further including first and second contact sections at respective forward ends thereof adapted to matingly engage each other, and said first and second terminal means including first and second forwardly facing stop means disposed forwardly of said first and second termination sections and first and second rearwardly facing stop means disposed rearwardly from said first and second forwardly facing stop means and forwardly of said first and second termination section;

first and second terminal housing subassembly means associated with said first and second terminal means respectively and including a respective first and second passageway extending from a rearward end to a forward end thereof within which a respective said first and second terminal means is disposed, said first and second terminal housing subassembly means including first and second rearwardly facing stop means cooperable with said first and second forwardly facing stop means of said first and second terminal means respectively to prevent axially forward movement of the terminal means, each of said first and second terminal housing subassembly means further including an enlarged passageway portion remote from said rearward and forward ends within which is disposed a first retention means between forward and rearward ends of said enlarged passageway portion in a manner preventing axially forward and axially rearward movement therealong, each said first retention means including inwardly and forwardly directed lances stoppingly engageable with a corresponding said rearwardly facing stop means of a respective one of said first and second terminal means to prevent axially rearward movement of said respective terminal means after full insertion of said respective terminal means into said terminal housing subassembly means, each said first and second terminal housing subassembly means including a second retention means secured therearound, each said second retention means including a forward end extending forwardly and radially inwardly to engage a rearwardly facing stop means around said terminal housing subassembly means and further including a rearward end spaced radially outwardly from said terminal housing subassembly means;

said first and second terminal means, when crimped to respective said conductor wires and inserted into said first and second terminal housing subassembly means, defining first and second terminal assemblies respectively;

first and second connector housing means including first and second terminal assembly-receiving passageways extending from a rearward face to a mating face thereof, said passageways receiving therein respective ones of said first and second terminal assemblies form said rearward face and including forwardly facing stop surfaces therealong cooperable with respective said rearward ends of said second retention means secured around respective said terminal housing subassembly means; and means for securing said first and second terminal assemblies within respective said first and second terminal assembly-receiving passageways of said first and second connector housing means against axially forward movement;

each of said first and second terminal housing subassembly means including a respective first and second hood section extending forwardly and surrounding said first and second contact section of a respective said first and second terminal means after full insertion of the terminal means thereinto, a respective first and second rearward section extending rearwardly and surrounding a respective said first and second termination section and extending still farther rearwardly surrounding an insulated length of the conductor to which the respective terminal means is crimped, whereby a connector assembly is defined which is adapted to minimize corona discharge events and thereby be suitable for high voltage applications.

2. A connector assembly as set forth in claim 1 wherein said second retention means is a C-shaped spring clip member crimpingly secured to said first and second terminal housing subassembly means respectively within respective annular clip receiving recesses thereof.

3. A connector assembly as set forth in claim 1 wherein said means for securing said first and second terminal assemblies within said first and second terminal assembly-receiving passageways against axially forward movement comprises a forwardly facing shoulder of said rearward section of said first and second terminal housing subassembly means cooperable with said rearward face of a respective one of said first and second connector housing means, said rearward section being dimensioned larger than the diameter of the assembly-receiving passageway.

4. A connector assembly as set forth in claim 3 wherein said first and second terminal assembly-receiving passageways of said first and second connector housing means each consist only of a larger diameter passageway portion extending rearwardly from said mating face of said housing means and a smaller diameter passageway portion extending forwardly from said rearward face thereof meeting said larger diameter passageway and defining said forwardly facing stop surfaces thereat, facilitating the molding of said first and second connector housing means molded as one-part dielectric members respectively.

5. A connector assembly as set forth in claim 1 wherein said first and second terminal housing subassembly means each comprises dielectric forward and rearward housing members sealingly secured together, said forward housing member including a rearwardly extending flange section having a selected outer diameter and an inner diameter selected to be slightly larger than the corresponding portion of a respective said terminal means to be disposed therewithin thereby defining an enlarged passageway portion, and said rearward housing member including a forwardly extending flange section defining a cavity therein having a transverse rearward end and an inner diameter just larger than said selected outer diameter of said rearwardly extending flange section of said forward housing member so that said cavity receives said rearwardly extending flange section insertably thereinto whereafter said forward and rearward housing members are bonded together along the interface between said forwardly and rearwardly extending flange sections, said cavity rearward end defining a forwardly facing stop surface, and said enlarged passageway portion including a rearwardly facing stop surface at its forward end whereby an internal recess is defined for retaining said first retention means therewithin.

6. A connector assembly as set forth in claim 5 wherein said first retention means is a C-shaped spring clip member secured within said internal recess of each said first and second terminal housing subassembly means prior to insertion of a respective said first and second terminal means thereinto, said C-shaped spring clip member originally having an outer diameter larger than said inner diameter of said internal recess.

7. A connector assembly as set forth in claim 1 wherein said first contact section is a pin and said second contact section is a socket matable with said pin, said first hood section includes a cavity surrounding said pin forwardly of a small diameter passageway portion, said small diameter passageway portion comprising said first rearwardly facing stop means cooperable with a larger diameter terminal portion just rearwardly of said pin contact section, said cavity having a diameter selected to be just larger than the outer diameter of said second hood section whereby said first hood section extends along the outer surface of said second hood section defining a substantially long voltage leakage path.

8. A connector assembly as set forth in claim 7 wherein said first hood section includes a tapered lead-in surface at and around the inner edge of the forward end thereof, and said second hood section includes a tapered lead-in surface at and around the outer edge of the forward end thereof, facilitating mating.

9. A connector assembly as set forth in claim 7 wherein said second hood section includes a forward section having a reduced inner diameter defining said second rearwardly facing stop means cooperable with a forward end of said socket contact section to prevent axially forward movement of said second terminal means within said second terminal housing subassembly after full insertion.

10. A connector assembly as set forth in claim 9 wherein said second hood section includes a tapered surface extending inwardly and rearwardly to comprise a means for aligning said pin during mating engagement.

11. A kit of parts for assembling an electrical connector for high voltage connections of first and second conductor wires, comprising:

a pin contact terminal crimpable to a stripped end of a first conductor wire;

a socket contact terminal crimpable to a stripped end of a second conductor wire;

a first terminal housing subassembly having a first terminal-receiving passageway into which the crimped pin contact terminal is insertable to define a first terminal assembly;

a second terminal housing subassembly having a second terminal-receiving passageway into which the crimped socket contact terminal is insertable to define a second terminal assembly; and first and second connector housings having terminal assembly-receiving passageways into which said first and second terminal assemblies are insertable respectively;

each of said first and second terminal housing subassemblies containing a first retention clip therewithin to secure by cooperating stop means a respective said pin and socket, contact terminal therewithin upon insertion, and further including a second retention clip therearound to retain by other cooperating stop means the housing subassembly within a respective said passageway of a respective said first and second connector housing upon insertion of said first and second terminal housing subassembly thereinto; and each of said first and second terminal housing subassemblies including a respective rearward section extending rearwardly from the termination of the stripped conductor wire to said pin and socket contact terminal respectively and along an insulated length of the respective said insulated conductor, to establish a long voltage leakage path for minimizing corona discharge events during in-service use.

12. A connector assembly suitable for high voltage applications to connect electrical conductors having conductor wires therein, comprising:

terminal means including respective termination sections at rearward ends thereof adapted to be crimped to stripped ends of respective conductor wires, said terminal means further including contact sections at respective forward ends thereof adapted to mate with corresponding contact sections of a mating connector, and said terminal means including forwardly facing stop means disposed forwardly of said termination sections and rearwardly facing stop means disposed rearwardly from said forwardly facing stop means;

terminal housing subassembly means associated with said terminal means respectively and including a respective passageway extending from a rearward end to a forward end thereof within which a respective said terminal means is disposed, said terminal housing subassembly means including rearwardly facing stop means cooperable with said forwardly facing stop means of said terminal means to prevent axially forward movement of the terminal means, each of said terminal housing subassembly means further including an enlarged passageway portion remote from said rearward and forward ends within which is disposed a first retention means between forward and rearward ends of said enlarged passageway portion in a manner preventing axially forward and axially rearward movement therealong, each said first retention means including inwardly and forwardly directed lances stoppingly engageable with a corresponding said rearwardly facing stop means of a respective one of said terminal means to prevent axially rearward movement of said respective terminal means into said terminal housing subassembly means, each said terminal housing subassembly means including a second retention means secured therearound, each said second retention means including a forward end extending forwardly and radially inwardly to engage a rearwardly facing stop means around said terminal housing subassembly means and further including a rearward end spaced radially outwardly from said terminal housing said terminal means, when crimped to respective said conductor wires and inserted into said terminal housing subassembly means, defining terminal assemblies;

connector housing means including terminal assembly-receiving passageways extending from a rearward face to a mating face thereof, said passageways receiving therein respective ones of said terminal assemblies from said rearward face and including forwardly facing stop surfaces therealong cooperable with respective said rearward ends of said second retention means secured around respective said terminal housing subassembly means; and means for securing said terminal assemblies within respective said terminal assembly-receiving passageways of said connector housing means against axially forward movement;

each of said terminal housing subassembly means including a respective hood section extending forwardly and surrounding said contact section of a respective said terminal means after full insertion of the terminal means thereinto, a rearward section extending rearwardly and surrounding a respective said termination section and extending still farther rearwardly surrounding an insulated length of the conductor to which the respective terminal means is crimped, whereby a connector assembly is defined which is adapted to minimize corona discharge events and thereby be suitable for high voltage applications.

13. A kit of parts for assembling an electrical connector for high voltage connections of conductor wires, comprising:

at least one contact terminal crimpable to a stripped end of a conductor wire and having a contact section;

a terminal housing subassembly having a terminal-receiving passageway into which the crimped contact terminal is insertable to define a terminal assembly; and a connector housing having terminal assembly-receiving passageways into which respective said terminal assembles are insertable;

each of said terminal housing subassemblies containing a first retention clip therewithin to secure by cooperating stop means a respective said contact terminal therewithin upon insertion thereof, and further including a second retention clip therearound to retain by other cooperating stop means the housing subassembly within a respective said passageway of said housing upon insertion of a respective said terminal housing subassembly thereinto; and each of said terminal housing subassemblies including a respective rearward section extending rearwardly from the termination of the stripped conductor wire to said contact terminal and along an insulated length of the respective said insulated conductor, to establish a long voltage leakage path for minimizing corona discharge events during in-service use.

* * * * *

UNITED STATES PATENT OFFICE

CERTIFICATE OF CORRECTION

Patent No. 4,834,678 Dated May 30, 1989

Inventor(s) Atahusain Emadi and Daniel J. Mignogna

It is certified that error appears in the above-identified patent and that said Letters Patent is hereby corrected as shown below:

In column 7, line 6, claim 1, "form" should be --from--.

In column 9, line 15, claim 11, after "insertion" add --thereof--.

Signed and Sealed this

Third Day of July, 1990

*Attest:*

HARRY F. MANBECK, JR.

*Attesting Officer*

*Commissioner of Patents and Trademarks*